United States Patent [19]

Gagnon

[11] Patent Number: 4,998,513

[45] Date of Patent: Mar. 12, 1991

[54] 4-STROKE, STRATIFIED GAS ENGINE

[75] Inventor: James J. Gagnon, Carrollton, Tex.

[73] Assignee: J-W Operating Company, Dallas, Tex.

[21] Appl. No.: 495,117

[22] Filed: Mar. 19, 1990

[51] Int. Cl.[5] ..... F02B 25/00

[52] U.S. Cl. ..... 123/76; 123/432; 123/90.15; 123/90.4

[58] Field of Search ..... 123/432, 76, 308, 65 VD, 123/90.4, 90.15

[56] References Cited

U.S. PATENT DOCUMENTS

| | | | |
|---|---|---|---|
| 4,445,467 | 5/1984 | Westerman et al. | 123/65 |
| 4,628,880 | 12/1986 | Aoyama et al. | 123/432 |
| 4,641,620 | 2/1987 | Yoshimura | 123/432 |
| 4,658,780 | 4/1987 | Hosoi | 123/315 |
| 4,669,434 | 6/1987 | Okumura et al. | 123/308 |
| 4,703,734 | 11/1987 | Aoyama et al. | 123/432 |
| 4,727,719 | 3/1988 | Mizutani | 60/611 |
| 4,809,649 | 3/1989 | Brinkman | 123/76 |
| 4,834,048 | 5/1989 | Adamis et al. | 123/432 |
| 4,840,147 | 6/1989 | Tanahashi et al. | 123/65 VD |
| 4,860,709 | 8/1989 | Clarke et al. | 123/432 |

*Primary Examiner*—E. Rollins Cross

*Attorney, Agent, or Firm*—Drude Faulconer

[57] ABSTRACT

A 4-stroke, internal combustion engine having two intake valves for each cylinder wherein a single rocker-arm assembly actuates both of the intake valves in a timed sequence to provide a stratified charge to the cylinder.

14 Claims, 3 Drawing Sheets

FIG. 1
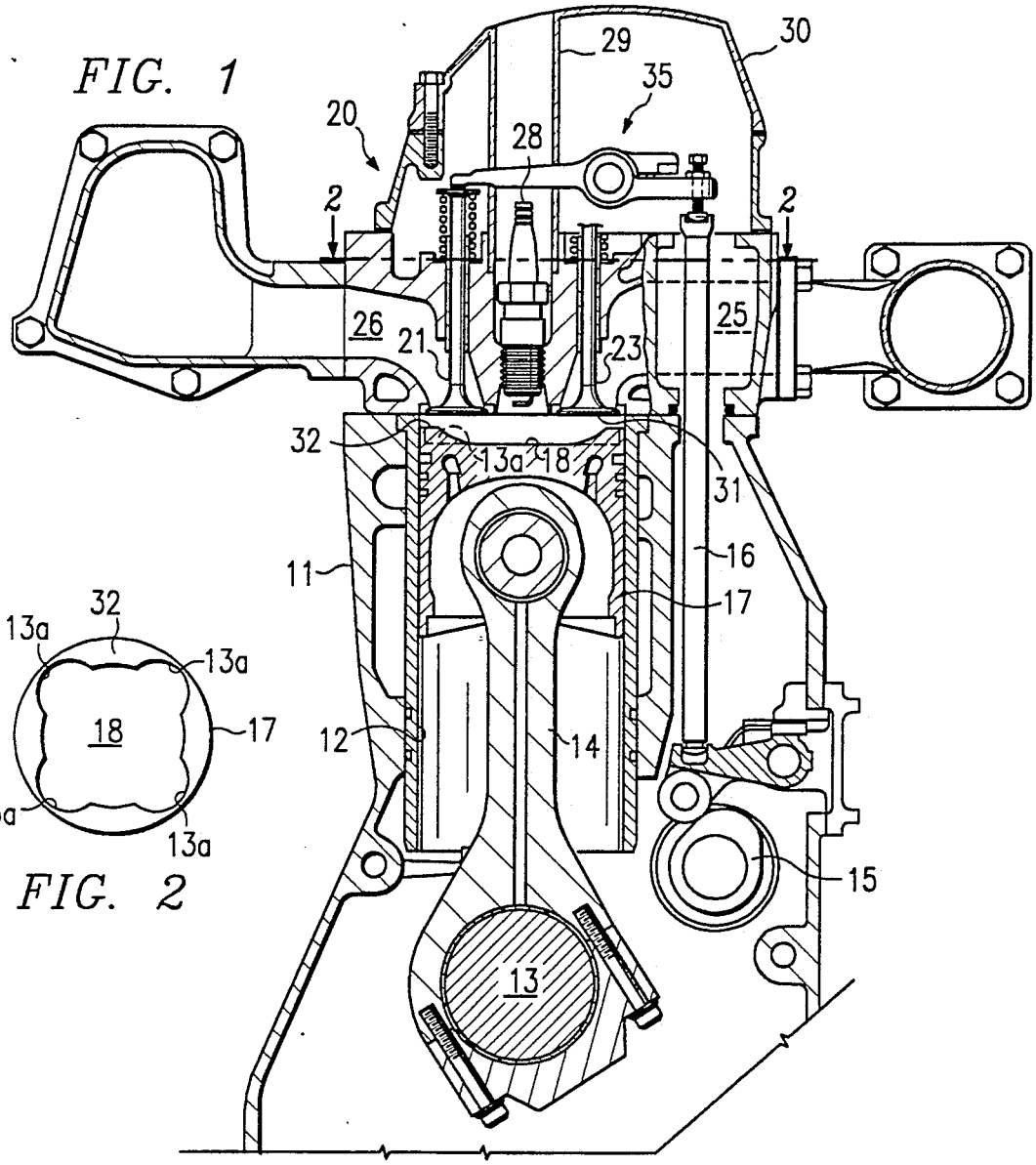
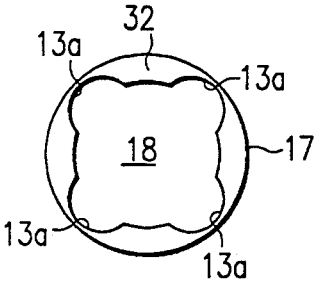
FIG. 2
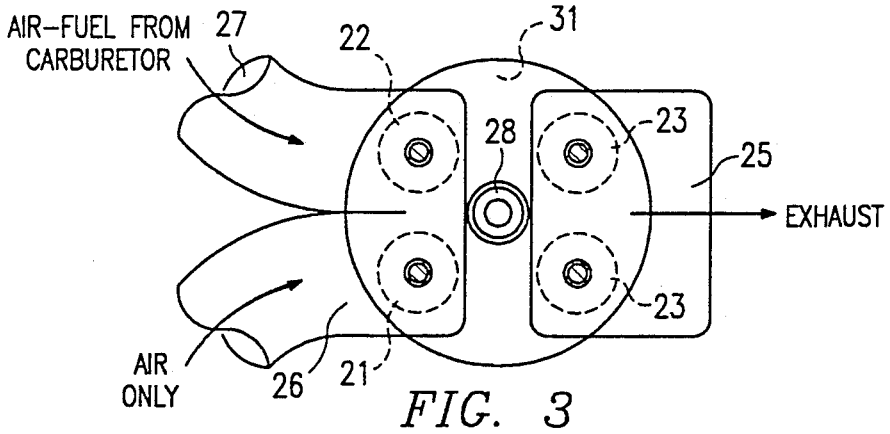
FIG. 3

4-STROKE, STRATIFIED GAS ENGINE

1. Technical Field

The present invention relates to engines and in one of its preferred aspects to a 4-stroke, internal combustion engine having two intake valves for each cylinder wherein a single rocker-arm assembly actuates both of the intake valves in a timed sequence to provide a stratified charge to the cylinder.

2. Background Art

In the early development of 4-stroke, internal combustion engines, little attention was given to fuel economy and/or harmful emissions which were outputted into the atmosphere in the exhaust from the engine. Recently, however, fuel conservation and environmental concerns have led to concentrated efforts to provide more efficient engines and to clean up the exhaust from the engines.

One such effort has involved increasing the intake and exhaust porting in the engines, e.g. providing multiple intake and exhaust valves for each cylinder of the engine, whereby there is a better distribution of the fuel charge in the cylinder and a larger portion of the total exhaust is removed during the exhaust stroke of the engine, see U.S. Pat. No. 4,658,780. In such multi-valve engines, further efforts have been made to improve their performance and emission control by supplying a fuel-air mixture to one of the intake valve while controlling the supply of air to the other of the intake valves in response to the speed of the engine, see U.S. Pat. Nos. 4,628,880; 4,669,434; 4,703,734; 4,727,719; and 4,834,048.

Still other efforts have involved "stratifying" the engine so that it will burn "cleaner" (less emissions such as nitrogen oxide (NOX) in the exhaust and operate on lean fuel-air mixtures. In a stratified-charge engine the intake air is not throttled. On the intake stroke, fuel is educted into the air and in a pattern that enfolds the spark plug. The spark ignites a combustible, but localized mixture and the flame need be propagated only in the region taken up by the fuel-enriched cloud along with the accompanying air.

U.S. Pat. No. 4,809,649 discloses a 4-stroke, internal combustion stratified-charge engine which has two intake valves per cylinder. A first intake valve (i.e. scavenging valve) is opened near the end of the exhaust cylinder to allow air to flow into the cylinder to aid in scavenging the exhaust from the cylinder. The other intake valve opens as the exhaust valve closes and the scavenging valve begins to close to allow a fuel-air charge to flow into the cylinder. The scavenging valve closes before the intake valve is fully opened so that substantially only the fuel-air mixture will flow into the cylinder during the intake stroke of the engine. While the disclosed engine provides an engine which is stratified, it requires a specially-designed, sophisticated cam shaft to operate the scavenging valves and the intake valves in their prescribed timing sequence.

The stratified engine and the diesel engine are quite similar in their methods of load control except that a spark is needed for combustion in an internal combustion engine. Since a large number of 4-stroke, 4-valves per cylinder engines are in use which have relatively high levels of NOX in their exhaust, it is desirable to convert these engines and other non-cleanburning engines to stratified engines which can operate on clean-burning fuels (e.g. natural gas, LPG, gasoline, etc.). To do this economically, the conversion needs to be done with a minimum of design changes so that the major original components of the engine can be used without substantial modification (e.g. the engine block and cylinders, the crankshaft and related bearings, the camshafts and push-rods for operating the valves, etc.).

DISCLOSURE OF THE INVENTION

The present invention provides a 4-stroke, internal combustion engine which has two intake valves and at least one exhaust valve for each cylinder wherein a single, rocker-arm assembly is actuated by a single push-rod to operate both intake valves in timed sequence to produce a stratified charge in the cylinder. While the present invention is equally applicable in the design of new engines, it is especially useful in converting existing, 4-stroke, four valves per cylinder , non-stratified engines (e.g. diesel and other fuels) to a clean burning, stratified-charged engines which will run on clean-burning fuels (e.g. natural gas, LPG, gasoline, etc.).

To convert a typical existing 4-stroke, four-valve per cylinder engine, the original pistons and head(s) are replaced with pistons and heads in accordance with the present invention. The head has two intake valves and at least one exhaust valve. The piston has a recess in the crown thereon which effectively forms the combustion chamber for the cylinder and has an annular surface on the crown which cooperates with a surface on said head within the cylinder to define a low clearance, squish area therebetween when the piston is at top dead center.

The intake manifolding on the original engine is changed so that there are two separate (e.g. dual-plane) intake manifolds; one being adapted to supply air, only, (from a turbocharger or the like) to the first of the two intake valves, and the other being adapted to supply a fuel-air mixture (from a carburetor or the like) to the second intake valve. Special single rocker-arm assemblies replace the original intake rocker-arms and are actuated, respectively, by the same single push-rods which actuated the original rocker-arms.

Each single, rocker-arm assembly is comprised of a first actuator (e.g. U-shaped rocker-arm with one leg of the U extended) which is engaged by the push-rod at the proper time during the exhaust stroke to open the first intake valve while the exhaust valves are still open. This permits air, only, to flow into the cylinder to aid in scavenging the exhaust and at the same time lays down a blanket of air on top of the piston. The rocker-arm assembly also includes a second actuator (T-shaped rocker-arm) which is mounted on the same shaft as the first actuator and which is actuated by the first actuator after a prescribed delay to open the second intake valve as the exhaust valves are closing. This permits the fuel-air charge to flow in on top of the air blanket without any substantial loss of fuel with the exhaust. The delay between the openings of the two intake valves is controlled by a compliance means (e.g. compression springs) which are positioned between the two actuators and which will absorb the initial rotational force developed by the rotation of the first actuator before compressing to rotate the second actuator. Both intake valves remain open during the intake stroke and both close substantially simultaneously when the single push-rod retracts from driving contact with the first actuator.

By providing interchangeable pistons, heads, and the rocker-arm assemblies of the present invention, a compatible 4-stroke, four-valve per cylinder, non-stratified, high-NOX emission engine can be quickly and relatively inexpensively converted into stratified engines which can be powered by clean burning fuels.

BRIEF DESCRIPTION OF THE DRAWINGS

The actual construction, operation, and apparent advantages of the present invention will be better understood by referring to the drawings in which like numerals identify like parts and in which:

FIG. 1 is a cross-sectional view, partly broken away, of a 4-stroke, internal combustion stratified gas engine in accordance with the present invention;

FIG. 2 is a top view of the piston of the engine of FIG. 1;

FIG. 3 is a sectional view taken along line 2—2 of FIG. 1 and simplified to better illustrate the intake and exhaust manifolding of the engine;

BEST MODE FOR CARRYING OUT THE INVENTION

Figure 4:
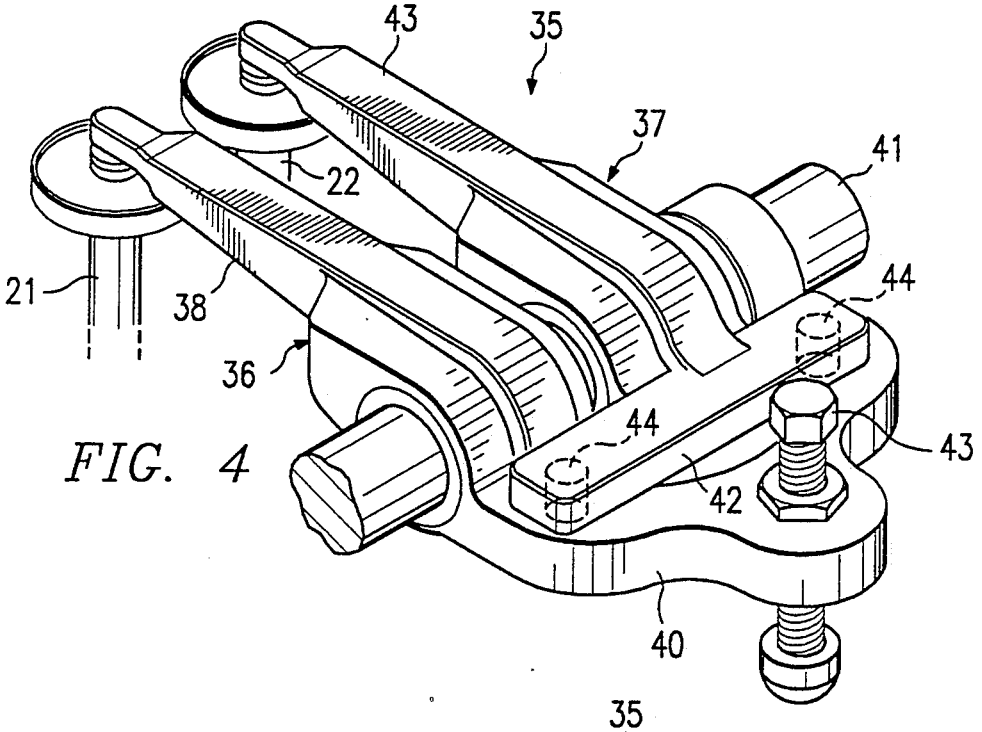
FIG. 4 is a perspective view of the rocker-arm assembly of the present invention.

Referring more particularly to the drawings, FIG. 1 is representative of a typical, commercially-available 4-stroke, internal combustion having four valves per cylinder engine which has been modified in present invention is described below in connection with the modification and conversion of an existing, 4-stroke, multi-valve per cylinder diesel engine, it should be understood that it equally used to modify other similar engines (e.g. gasoline, natural gas, LPG, etc.) or to design of an engine built especially in accordance with the present invention.

As illustrated, engine 10 is a multi-cylinder (only one shown), 4-stroke, diesel engine which has four valves (i.e. two intake and two exhaust) per cylinder and which has been modified to become a 4-stroke, stratified gas engine in accordance with the present invention. Engine 10 is comprised of an engine block 11 having at least one cylinder bore 12 formed therein. Although, engine 10 will normally have more than one cylinder, only one will be described in detail since all of the cylinders are basically of the same construction. Crankshaft 15 reciprocates piston rod 14 within cylinder 12 and operates camshaft 16 which, in turn, reciprocates intake push rods 16 to open and close the intake valves as will be explained in more detail below. The push rods which operate the exhaust valves are not shown for the sake of clarity. The structure described up to this point is basically the same as that found in known engines of this type (e.g. Dorman 6SE Diesel Engine, available from Dorman Diesel Limited, Stafford, England) and the operation thereof will be fully understood by those skilled in this art.

In accordance with the present invention, a special piston 17 having a recess 18 in the crown thereof is secured to the end of piston rod 14 and is slidably mounted within bore 12. As best seen in FIG. 2, recess 18 is configured so that it has "cut-outs" 13*a* at each of its "four corners" which are adapted to receive the valves when they move downward to their respective open positions. Where engine 10 is one which is being modified, such as the diesel engine in FIG. 1, piston 17 will replace the original piston with the engine block, cylinders, crankshaft, etc. remaining unchanged. Likewise, head 20 of the present invention replaces the original four-valve per cylinder head of the diesel engine and is secured to block 11 in the same manner as was the original head, e.g. bolts, gaskets, etc.. Head 20 has two intake ports which are opened and closed by a first intake valve 21 and a second intake valve 22, respectively, (FIGS. 3, 4, and 6) and has at least one exhaust valve 23 (two shown).

The exhaust manifolding 25 in head 20 is basically the same as in the prior four valve per cylinder engine in that both exhaust valves 23 open into a common manifold 24. The intake manifold is different however, in that first intake valve 21 is supplied through a first manifold 26 while second intake valve 22 is supplied through a separate manifold 27 for a purpose described later. While the intake manifold has been shown as a split manifold in FIG. 3, for the sake of illustration, it should be understood that the intake manifold can take other configurations, e.g. dual-plane manifold. An ignition means (e.g. spark plug 28) is mounted in head 20 in approximately the same position as previously occupied by the fuel injector of the original diesel head. A tube 29 extends through the valve cover 30 to provide access to spark plug 28 and isolate it from the oil normally present in cover 30, as will be understood in the art.

Head 20 provides a surface 31 on the lower side thereon which extends between the valve openings at the upper end of cylinder bore 12 when head 20 is in place on the block 11. Surface 31 cooperates with surface 32 (FIG. 2) which extends around the periphery of the crown of piston 17 between cut-outs 13*a* whereby the two surfaces 31, 32 define a low clearance "squish" area therebetween when piston 17 is substantially at top dead center in bore 12, for a purpose described later.

Figure 7:
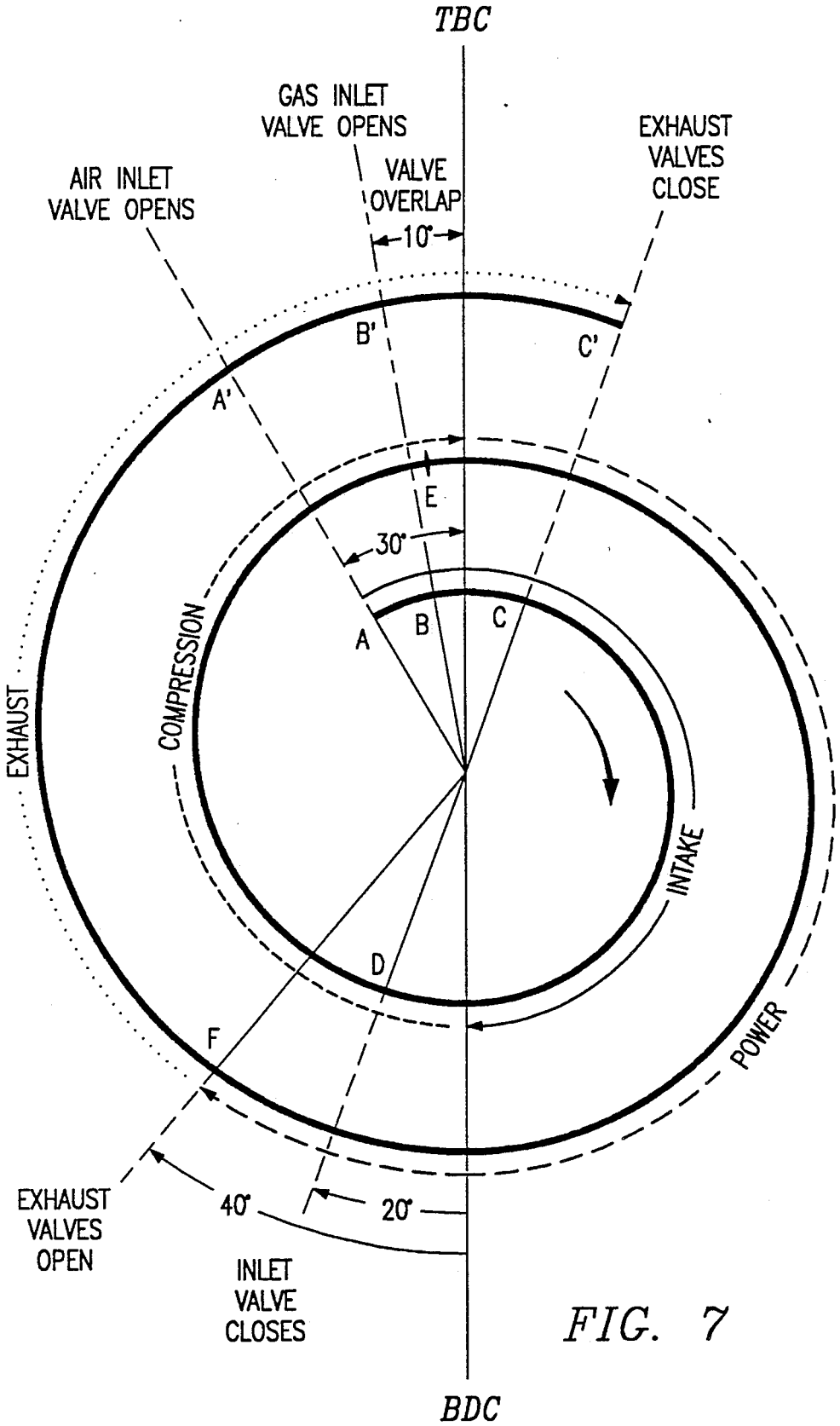
FIG. 7 is a valve timing diagram for the engine of FIG. 1.

The operation of engine 10 and how a stratified charge is provided in cylinder 12 will be better understood by referring to the valve timing diagram in FIG. 7. Starting at point A on the diagram, which lies on the exhaust stroke of piston 17 near top dead center (TDC), first intake valve 21 opens while exhaust valves 23 are also open. Air, only, is supplied from a turbocharger or the like (not shown) through manifold 26 and flows through open first intake valve 21 to aid in scavenging the exhaust from cylinder 12 through open exhaust valves 23. Since only air is flowing into the cylinder through first intake valve 21, there will be no fuel wasted during this scavenging period. Also, a blanket of air is laid down on the crown of piston 17 as the exhaust is being scavenged from the cylinder. At point B (approximately 20° of angular rotation of crankshaft 15 past point A), second intake valve 22 opens to allow a fuel-air mixture from a carburetor or the like (not shown) to flow through second manifold 27 into cylinder 12 through second intake valve 22 just before piston 17 reaches TDC. Exhaust valves 23, which are closing as second intake valve 22 begins to open, completely close at point C and both air and the fuel-air mixture continue to flow into the cylinder through their respective intake valves during the intake stroke of piston 17. After piston 17 reaches bottom dead center (BDC) and starts upward on the compression stroke, both inlet valves 21, 22 close substantially at the same time (point D). As piston 17 approaches TDC, ignition occurs at point E to drive piston 17 downward through the power stroke. The exhaust valves 23 both open at point F and the four strokes are repeated as will be understood in the art. While specific degrees of camshaft rotation have been indicated on the diagram of FIG. 7, these are meant to be by way of example only and will obviously vary depending on the actual engine and the operating circumstances involved in a particular application.

As can be seen in FIG. 1, the combustion chamber for the cylinder 12 is formed primarily of recess 18 in the crown of piston 17 when the piston is substantially at TDC. By opening first intake valve 21 during the exhaust stroke while the exhaust valves are still open, only air is used to scavenge the exhaust from the cylinder and only substantially air will be left in the cylinder on top of the piston when the piston nears TDC during the exhaust stroke. When second intake valve 22 begins to open, exhaust valves 23 are substantially closed so little, if any, fuel-air mixture will be lost out the exhaust. This not only improves the fuel economy for engine 10 but also reduces undesirable emissions in the exhaust. Also, by flowing the fuel-air mixture in on top of the blanket of air in the cylinder, a substantial amount of the fuel remains on top of the air blanket during the compression stroke thereby providing a "stratified" charge of rich fuel-air around the spark plug 28 which is rich enough to support ignition and quickly spread the resulting flame to the leaner mixture in the lower portion of recess 18.

Further, the "squish" area between surfaces 31, 32, in addition to forcing additional air and fuel-air mixture into recess 18 as piston 17 approaches TDC during the compression stroke, also has the effect of reducing or breaking the swirl of the leaner mixture in the lower portion of the combustion chamber (recess 18) while increasing the turbulence, hence mixing, of the richer mixture in the upper portion of the combustion chamber. This results in concentrating and maintaining the stratified charge, i.e. richer mixture in the upper portion to insure ignition. Also, the burning of the leaner "stratified" fuel-air charge substantially reduces the NOX in the exhaust of engine 10.

Figure 5:
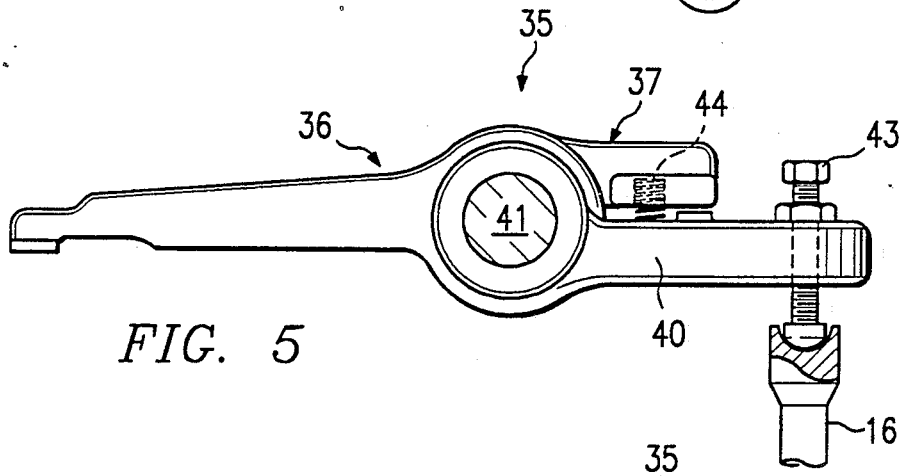
FIG. 5 is a side view of the rocker-arm assembly of FIG. 4.

In order to provide the timing sequence of the intake valves in accordance with the present invention, a single rocker-arm assembly 35 (FIGS. 4–6) is provided for each cylinder to operate both of the intake valves from a single push-rod, which, in turn, is operated by a single lobe on the camshaft. Again, where the engine is one which is being converted (diesel engine), single rocker-arm assemblies 35 (only one shown) replaces the original intake rocker-arms which were actuated by original push-rod 16.

Figure 6:
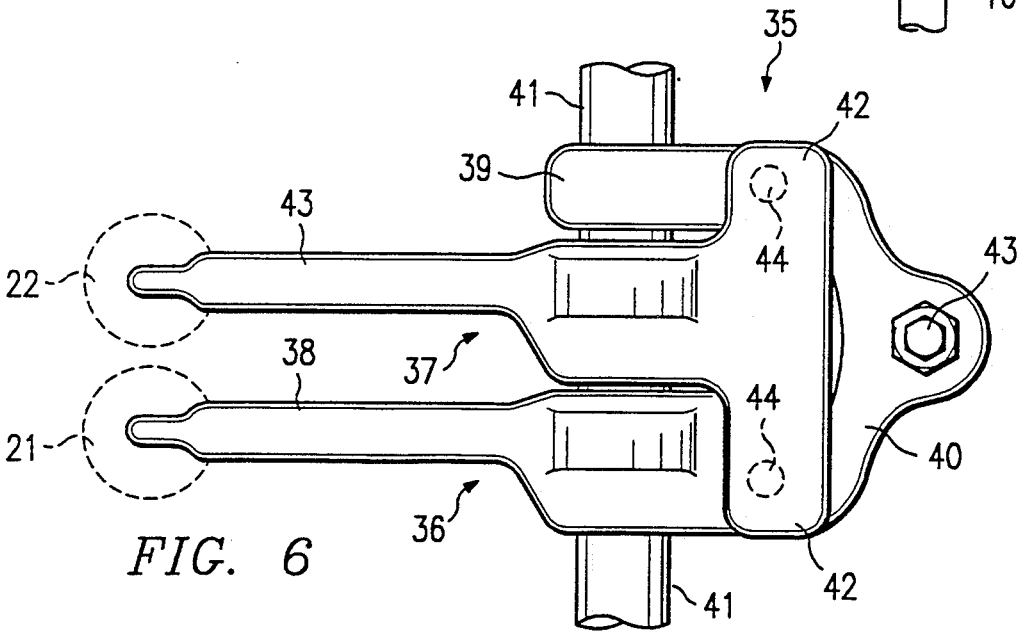
FIG. 6 is a plan view of the rocker-arm assembly of FIG. 4.

Rocker-arm assembly 35 is comprised of (a) a first actuator 36 which is adapted to open first intake valve 21 at the proper time in the 4-stroke cycle and (b) a second actuator 37 which is adapted to be actuated by the first actuator 36 after a prescribed time delay to open the second intake. More specifically, first actuator 36 of single rocker-arm assembly 35 is comprised of a U-shaped member formed by two legs 38, 39 connected by back 40 (see FIG. 6). first actuator 36 is rotatably mounted on fixed shaft 41 which passes through aligned openings in both legs of the U-shaped member as shown in FIG. 6. Position at approximately the middle of back 40 is an adjusting screw 43 which is adjusted to be engaged by push-rod 16 at the proper time in the timing cycle to rotate actuator 36 about shaft 41. Elongated leg 38 extends outward from the shaft 41 whereby its outer end overlies and is adapted to engage first intake valve 21 to move it to an open position when said first actuator is rotated by push-rod 16.

Second actuator 37 is comprised of a T-shaped member which is also rotatably mounted on fixed shaft 41 between legs 38, 39 of first actuator 36 whereby outer ends 42 of the cross portion of the T overlies said legs, respectively, and the outer end of the stem portion 43 of the T extends over second intake valve 22. Compliance means, e.g. compression springs 44, is positioned between the first and second actuators whereby second actuator 37 is actuated by first actuator 36 through the compliance means 44. That is, when first actuator is actuated by push-rod 16, the initial rotational force developed by first actuator 37 will be absorbed by springs 44 so that second actuator 38 remains at rest and second intake valve remains closed until continued rotation of first actuator 36 by push-rod 16 compresses springs 44 to effectively convert the springs into a positive drive connection which then rotates second actuator 37 to open second intake valve after a prescribed time delay. Other types of compliance means may be used in place of springs (e.g. hydraulic lifters, etc.) to provide the prescribed time delay between the opening of the intake valves.

By providing a compliance connection between the actuators, a single rocker-arm assembly, actuated by a single push-rod, can be used to open both of the intake valves at their respective prescribed times in the timing cycle. The compliance provided by springs 44 between the actuators is highly desirable for smooth operation of the valves since both intake valves are effectively actuated in response to a single lobe on camshaft 15 (FIG. 1) and the "rate of rise" of the cam at the time the second intake valve is to open is such that the cushioning effect of springs 44 are needed to ease the transition between the actuators and extend the operational life thereof. Harden surfaces, stellite, (not shown) may be provided on rocker-arm assembly 35 at those places which receive substantial wear, e.g. end of leg 38 which engages valve 21, stem 43 which engages valve 22, surfaces between the actuators which engage each other, etc.

What is claimed is:

1. A 4-stroke, internal combustion, stratified engine comprising:

at least one cylinder having two intake valves and at least one exhaust valve;

a first manifold adapted for supplying only air to the first of said two intake valves;

a second manifold adapted for supplying a fuel-air mixture to the second of said two intake valves;

means for opening said first intake valve during the exhaust stroke of said engine while said at least one exhaust valve is open whereby air flowing through said first intake valve aids in scavenging the exhaust from said cylinder;

means for opening said second intake valve after said first intake valve is opened and as said at least one exhaust valve closes to allow said fuel-air mixture to flow into said cylinder without any substantial loss of fuel in the exhaust; and means for simultaneously closing both said first and second intake valves after completion of the intake stroke of said engine.

2. The engine of claim 1 wherein said means for opening and closing said first and second intake valves comprise:

a single rocker-arm assembly comprising:

a first actuator for opening said first intake valve;

a second actuator, actuated by said first actuator, for opening said second intake valve; and means for actuating said first actuator.

3. The engine of claim 2 wherein said means for actuating said first actuator comprises a push-rod.

4. The engine of claim 3 wherein said first actuator comprises:

a first rocker-arm rotatably mounted on a shaft and having one end adapted to be engaged by said push-rod to rotate said rocker arm on said shaft, said first rocker-arm having another end adapted to engage said first valve to move said valve to an open position when said first rocker-arm is rotated by said push-rod; and wherein said second actuator comprises:

a second rocker-arm rotatably mounted on said shaft and having a portion overlying said first rocker-arm and having an end adapted to engage second intake valve to move said second valve to an open position when said second rocker-arm is rotated on said shaft; and compliance connection means positioned between said first and second rocker-arms for delaying rotation of said second rocker-arm for a prescribe time after said push-rod the start of rotation of said first rocker-arm.

5. The engine of claim 4 wherein said compliance connection means is comprised of compression springs.

6. A 4-stroke, internal combustion engine comprising:

an engine block;

at least one cylinder in said block;

a piston slidably mounted in said cylinder, said piston having a crown thereon;

a head mounted on said block over said cylinder and having two intake valves and at least one exhaust valve;

a single rocker-arm assembly comprising:

a first actuator means for opening the first of said two intake valves; and a second actuator means, actuated by said first actuator means, for opening the second of said two intake valves after said first intake valve is open; and means for actuating said first actuator means.

7. The engine of claim 6 including:

a first intake manifold adapted to supply only air to said first intake valve; and a second intake manifold adapted to supply a fuel-air mixture to said second intake valve.

8. The engine of claim 7 wherein;

said piston has a recess in said crown and a surface around the upper periphery of said crown;

said head having a surface adjacent the upper periphery of said cylinder wherein surfaces define a low clearance squish area therebetween when said piston is at top dead center in said cylinder.

9. The engine of claim 8 wherein said means for actuating said first actuator comprises a push-rod.

10. The engine of claim 9 wherein said first actuator comprises:

a first rocker-arm rotatably mounted on a shaft and having one end adapted to be engaged by said push-rod to rotate said rocker arm on said shaft, said first rocker-arm having another end adapted to engage said first valve to move said valve to an open position when said first rocker-arm is rotated by said push-rod; and wherein said second actuator comprises:

a second rocker-arm rotatably mounted on said shaft and having a portion overlying said first rocker-arm and having an end adapted to engage second intake valve to move said second valve to an open position when said second rocker- arm is rotated on said shaft; and compliance connection means positioned between said first and second rocker-arms for delaying rotation of said second rocker-arm for a prescribed delay time after said push-rod start rotating said first rocker-arm.

11. The engine of claim 10 wherein said compliance connection means is comprised of compression springs.

12. A rocker-arm assembly for operating a first and a second intake valve in a 4-stroke internal combustion engine comprising:

a first rocker-arm adapted to be rotatably mounted on a shaft within the engine and having one end adapted to be engaged by a push-rod in said engine to rotate said rocker arm on said shaft, said first rocker-arm having another end adapted to engage said first valve to move said valve to an open position when said first rocker-arm is rotated by said pushrod; and a second rocker-arm adapted to be rotatably mounted on said shaft and having a portion overlying said first rocker-arm and having an end adapted to engage second intake valve to move said second valve to an open position when said second rocker-arm is rotated on said shaft; and compliance connection means positioned between said first and second rocker-arms for rotating said second rocker-arm after a prescribed time delay after the push-rod begins rotating said first rocker-arm.

13. The rocker-arm assembly of claim 12 wherein said compliance connection means is comprised of compression springs.

14. The rocker-arm assembly of claim 13 wherein said first rocker-arm comprises:

a U-shaped rocker-arm having two legs connected by a back, each of said legs having aligned openings therethrough for receiving a shaft, one of said legs being elongated to extend forward of said opening to provide an end which is adapted to engage said first intake valve when said rocker-arm is on said shaft, said back being adapted to be engaged by said push-rod when said U-shaped rocker-arm is in an operable position; and wherein said second rocker-arm comprises:

a T-shaped rocker-arm defined by a cross portion and a stem portion, said stem having an end and having an opening adapted to receive said shaft whereby said second rocker-arm will be mounted on said shaft between said legs of said first rocker-arm when both are mounted on said shaft with said end of said stem adapted to engage said second intake valve, said cross portion having ends which overlie said legs, respectively of said first rocker-arm; and wherein said compliance connection means is positioned between said ends of said cross portion of said T-shaped rocker-arm and said legs of said U-shaped rocker-arm.

* * * * *